US006237345B1

(12) United States Patent
Kalman et al.

(10) Patent No.: US 6,237,345 B1
(45) Date of Patent: May 29, 2001

(54) WATER COOLER AND DISPENSER

(75) Inventors: Jeffrey M. Kalman, Cleveland Heights; Richard O. McCarthy, Strongsville; John R. Nottingham, Hunting Valley; Jeffrey S. Plantz, Seven Hills; John W. Spirk, Gates Mills, all of OH (US)

(73) Assignee: Home Pure L.L.C., Hoffman Estates, IL (US)

( * ) Notice: Subject to any disclaimer, the term of this patent is extended or adjusted under 35 U.S.C. 154(b) by 0 days.

(21) Appl. No.: 09/292,992

(22) Filed: Apr. 16, 1999

Related U.S. Application Data

(60) Provisional application No. 60/082,220, filed on Apr. 17, 1998.

(51) Int. Cl.[7] ..... F25B 21/02
(52) U.S. Cl. ..... 62/3.64; 62/391
(58) Field of Search ..... 62/3.64, 3.7, 391; 222/146.6

(56) References Cited

U.S. PATENT DOCUMENTS

| | | | |
|---|---|---|---|
| 3,269,143 | 8/1966 | Gasparovich . | |
| 3,333,438 | 8/1967 | Benua et al. . | |
| 3,541,808 | 11/1970 | Materese . | |
| 4,699,188 | 10/1987 | Baker et al. . | |
| 4,723,688 | 2/1988 | Munoz . | |
| 4,730,463 | 3/1988 | Stanfill . | |
| 4,866,945 | 9/1989 | Bender et al. . | |
| 4,885,081 | 12/1989 | Oliver . | |
| 4,940,164 | 7/1990 | Hancock et al. . | |
| 4,958,747 | 9/1990 | Sheets . | |
| 5,064,097 | 11/1991 | Brog et al. . | |
| 5,111,966 | 5/1992 | Fridman . | |
| 5,147,533 | 9/1992 | Lipshultz et al. . | |
| 5,443,739 | 8/1995 | Vogel et al. . | |
| 5,544,489 | 8/1996 | Moren . | |
| 5,845,504 * | 12/1998 | LeBleu | 62/92 |

* cited by examiner

*Primary Examiner*—William Doerrler
*Assistant Examiner*—Mel Jones
(74) *Attorney, Agent, or Firm*—Nenad Pejic; Calfee, Halter & Griswold LLP

(57) ABSTRACT

A dispener comprising a liquid supply and a cooling reservoir, the cooling reservoir having an entry port and an exit port. The cooling reservoir is shaped so as to position a pocket of air at the top of the reservoir when the reservoir contains liquid, and the entry port communicates with the air pocket. The dispenser has a conduit connected on one end to the liquid supply and on the other end to the entry port of the cooling reservoir. The dispenser further comprises a cooling element disposed inside the cooling reservoir and a first pump for moving the liquid from the liquid supply to the cooling reservoir through the conduit.

32 Claims, 8 Drawing Sheets

WATER COOLER AND DISPENSER

This application claims the benefit of U.S. Provisional Application No. 60/082,220 Apr. 17, 1998.

BACKGROUND OF THE INVENTION

The present invention is directed to a dispenser for cooling and dispensing liquids, and more particularly, a dispenser for cooling and dispensing liquids which can continue to dispense liquids even when the liquid in the cooling reservoir is frozen.

In order to store and cool liquids for consumption, such as water, it is known to provide a cooling reservoir for storing the water, and to connect a spigot to the cooling reservoir for dispensing the water. A thermoelectric device may be used to cool the water before it is dispensed. For example, U.S. Pat. No. 5,544,489 to Moren discloses an apparatus for dispensing a cooled liquid which utilizes a thermoelectric device. The apparatus disclosed in that patent includes a compartment having a wall for retaining the water to be cooled and dispensed. A thermoelectric device having a first surface with a relatively cool temperature and a second surface having a relatively high temperature is located adjacent to the compartment. A cooling probe is coupled to the first surface, and extends through the compartment wall such that it cools the water in the compartment. The thermoelectric cooling device is commercially available, and produces a temperature differential upon application of a direct voltage due to the Peltier effect.

However, water coolers such as disclosed in the Moren patent can be troublesome due to the fact that the entire volume of liquid in the cooling reservoir may freeze completely. Under such "freeze-up" conditions, the liquid can no longer be dispensed and the cooler is rendered inoperable. Various arrangement of fans, timers, temperature controls, and feed back loops have been utilized in attempts to address the freeze-up problem. However, these measures are complicated to implement and utilize, and largely unreliable in preventing freeze-up. Accordingly, there is a need for a liquid cooler and dispenser which can effectively cool and dispense water, and that can remain operable during freeze-up of the cooling reservoir.

SUMMARY OF THE INVENTION

The present invention is a dispenser for cooling and dispensing liquids which can continue to dispense liquids even when the liquid in the cooling reservoir becomes frozen. In place of the complicated controls and devices of the prior art, the present invention utilizes a pocket of trapped air, or "air bubble," to counteract freeze-up of the entire cooling reservoir.

More particularly, the present invention is a dispener comprising a liquid supply and a cooling reservoir, the cooling reservoir having an entry port and an exit port. The cooling reservoir is shaped so as to position a pocket of air at the top of the reservoir when the reservoir contains liquid, and the entry port communicates with the air pocket. The dispenser has a conduit connected on one end to the liquid supply and on the other end to the entry port of the cooling reservoir. The dispenser further comprises a cooling element disposed inside the cooling reservoir and a first pump for moving the liquid from the liquid supply to the cooling reservoir through the conduit.

Other features and advantages of the present device will become apparent from the following detailed description, with reference to the accompanying drawing and claims, which form a part of the specification.

BRIEF DESCRIPTION OF THE DRAWINGS

In the accompanying drawings, which are incorporated in and constitute a part of this specification, numerous embodiments of the device described are illustrated, and together with the generally description above, and the description and claims below, exemplify the device of the present application.

DETAILED DESCRIPTION

Figure 3:
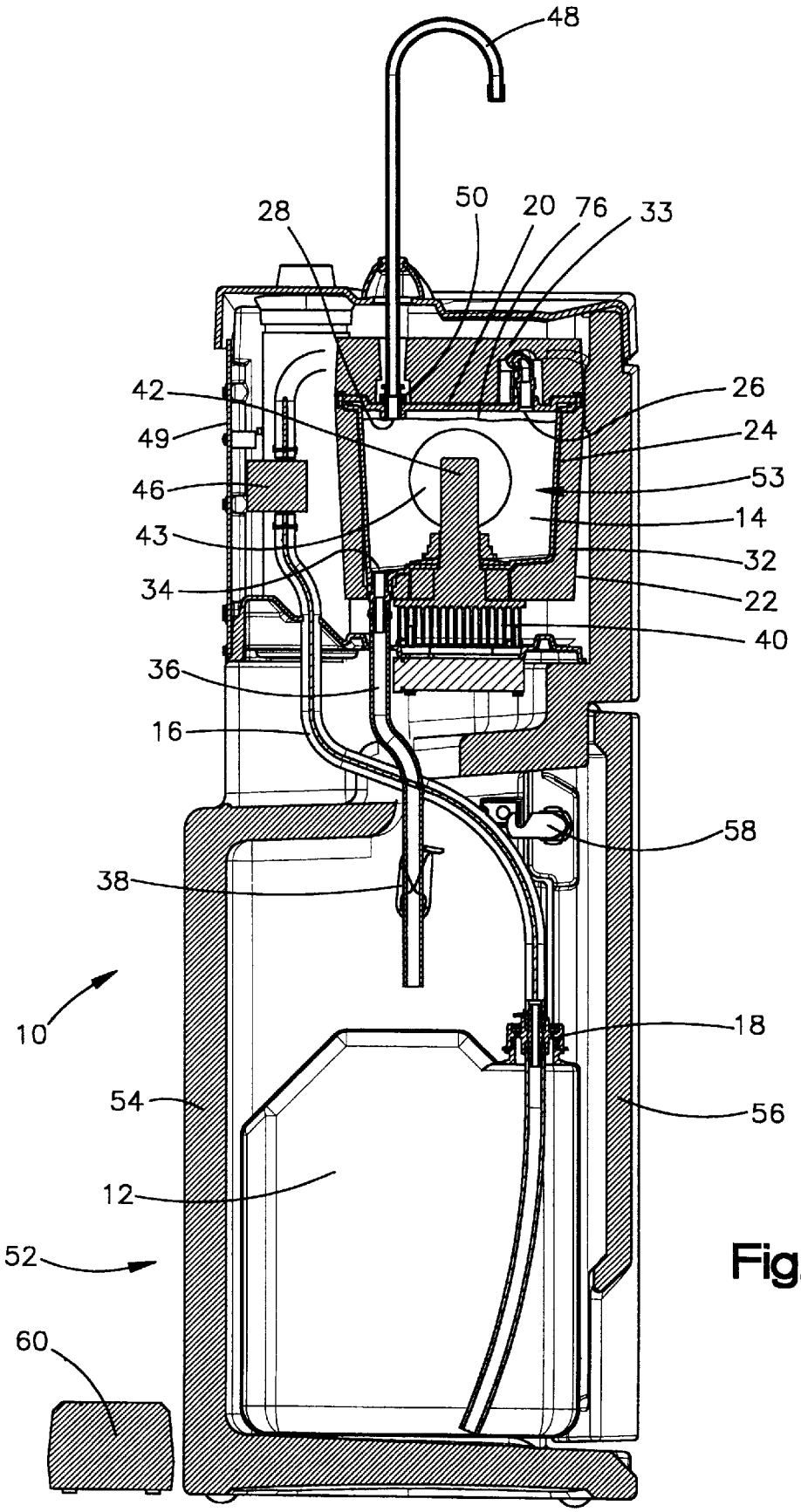
FIG. 3 is a side cross-sectional view of the water cooler and dispenser of FIG. 1.
Figure 4:
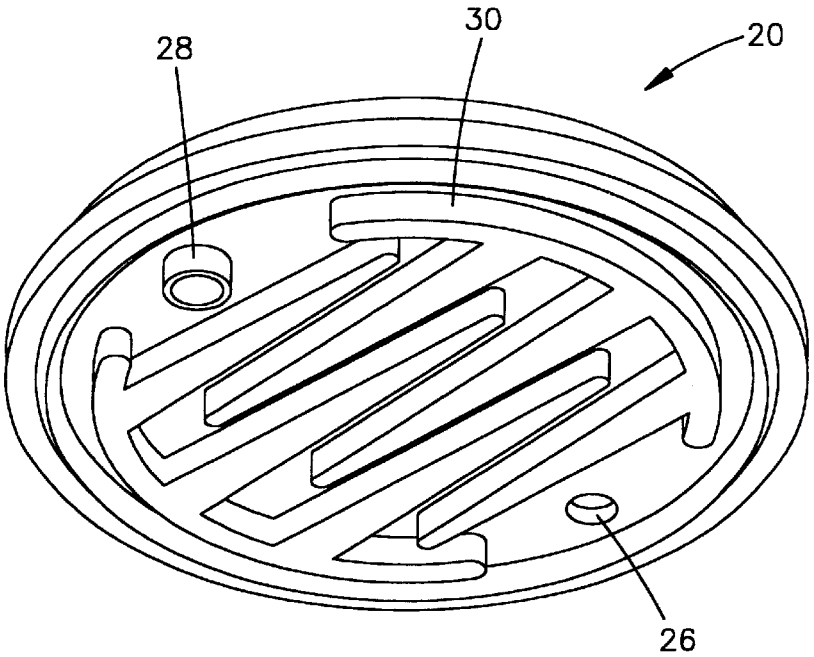
FIG. 4 is a detailed perspective view of a preferred form of the cooling reservoir cover.

As shown in FIG. 3, the dispenser 10 of the present invention includes a liquid supply 12, a cooling reservoir 14, and a conduit 16 connecting the liquid supply 12 to the cooling reservoir 14. The liquid supply 12 includes a top port 18, and supplies the liquid to be cooled and dispensed. Nearly any size or shape of liquid supply 12 may be used, as long as the conduit 16 may be passed into the liquid in the liquid supply 12. The cooling reservoir 14 includes a cover 20, a bottom 22 and a side wall 24, although other shapes of the cooling reservoir 14 may be used without departing from the scope of the invention. An entry port 26 and an exit port 28 are formed in the cover 20. The cover 20 is further shaped to trap one or more air bubbles when the cooling reservoir is filled with liquid, as will be discussed in greater detail below. The conduit 16 is connected to the entry port 26, and the exit port 28 is lower than the entry port 26. As best shown in FIG. 4, the cover 20 may also include a set of baffles 30 to divert the path of water entering the cooling reservoir 14. In this manner, warm water entering the reservoir is mixed with the cooled water present in the cooling reservoir, thereby ensuring that cool water exits through the exit port 28. The baffles 30 may preferably have a height of around 1.5 inches.

Figure 6:
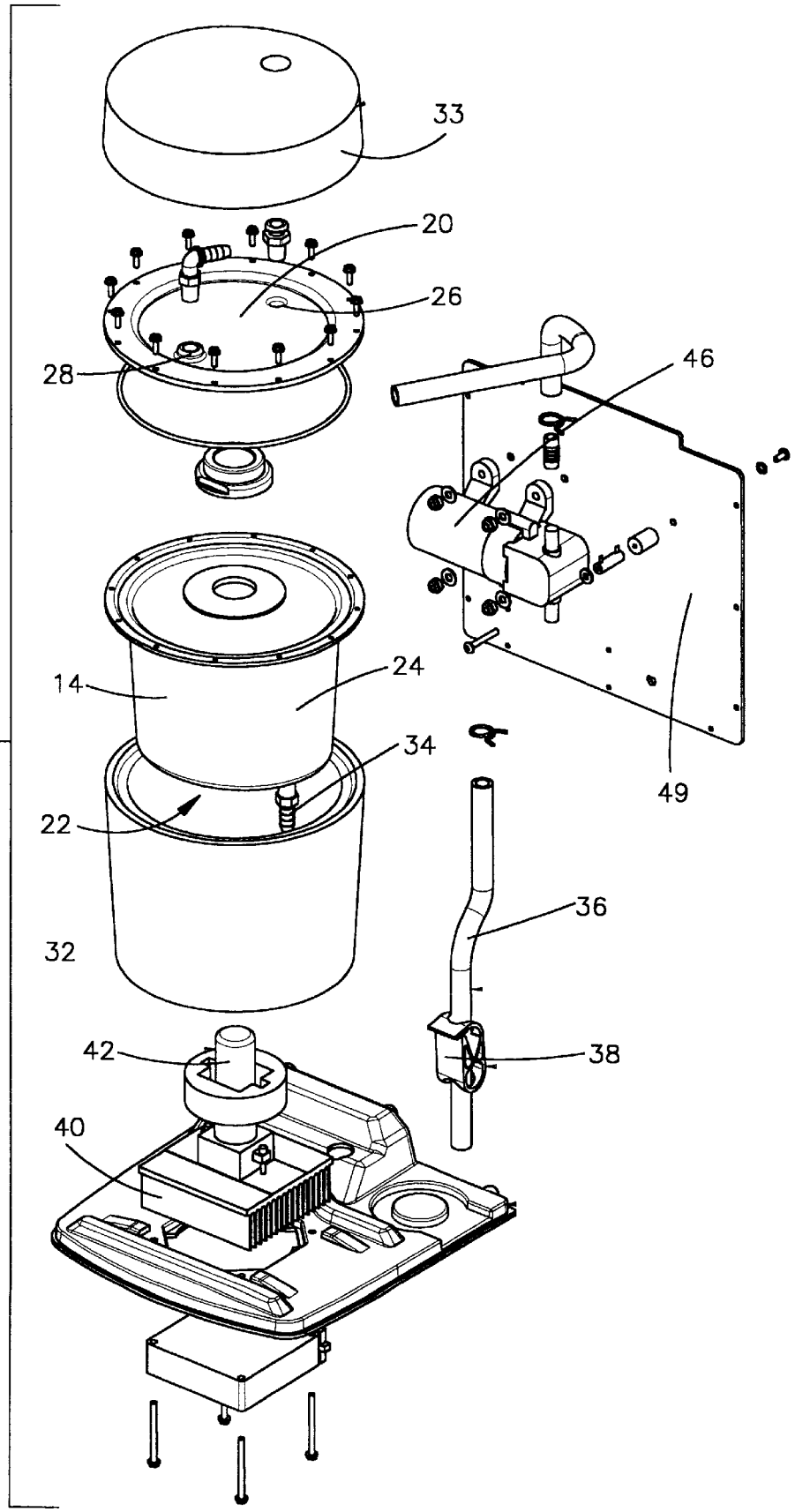
FIG. 6 is a perspective, exploded view of the cooling reservoir and associated components.

Insulating sleeve 32 (FIG. 6) surrounds and insulates the cooling reservoir 14, and the sleeve 32 may be made of a any of a wide range of thermally insulating materials, including STYROFOAM™. An insulating cap 33 tops the cooling reservoir 14. The cooling reservoir 14 also has a drain 34 which is coupled to a drain tube 36. The drain 34 allows the cooling reservoir 14 to be emptied for cleaning and maintenance. The drain tube 36 has a removable pinch-clip 38 mounted thereon to control drainage out of the cooling reservoir 14.

Figure 3A:
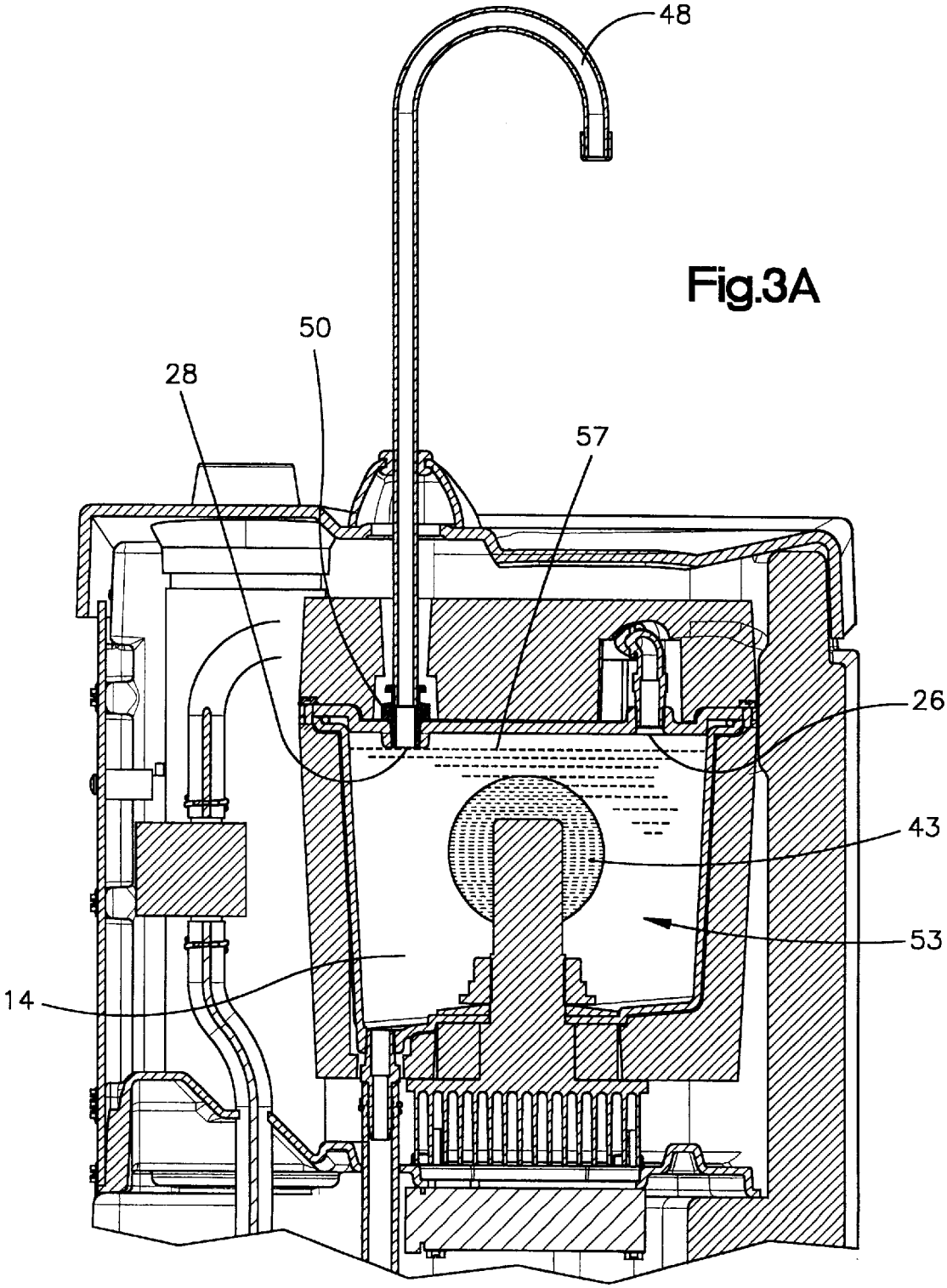
FIG. 3A is a detail view of the cooling chamber of FIG. 3.
Figure 7:
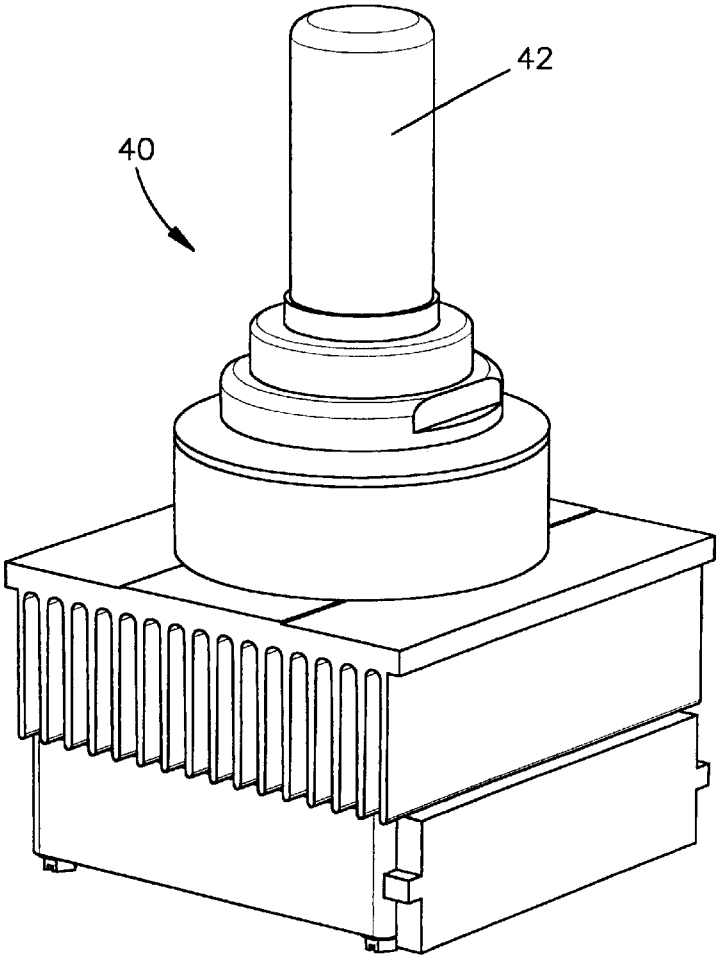
FIG. 7 is a perspective view of the thermoelectric cooling device for use with the present invention.

A thermoelectric cooling device 40 is located below the cooling reservoir 14, and FIG. 7 more fully illustrates the cooling device 40. A cooling element, such as a cooling probe 42, is coupled to the cold side of the thermoelectric device 40, and is passed through a hole in the bottom 22 of the cooling reservoir 14. In this manner, the cooling probe 42 absorbs heat from the water in the cooling reservoir, reducing the temperature of the water in the reservoir 14. Due to the cooling effect, an iceball 43, as shown in FIG. 3A, may form around the probe 42. When the ice ball 43 becomes large enough so as to take up all the space in the reservoir, "freeze-up" conditions result. It should be understood that although the cooling probe is shown as passed through the bottom 22 of the cooling reservoir 14, it may enter the cooling reservoir 14 at nearly any location. Additionally, the entry 26 and exit 28 ports may be located in the side wall 24 of the cooling reservoir 14 if desired. It is to be further understood that while the device of the present invention may be described herein as used with primarily with water, the invention may be used with any liquid, water or otherwise, which is desired to be cooled and/or dispensed.

Pump 46 is mounted to the backing plate 49, and receives the conduit 16 (FIG. 3). When activated, the pump 46 moves water from the supply 12 to the cooling reservoir 14 through the conduit 16. In a preferred embodiment, the pump 46 is a sealed pump. A spigot 48 is coupled to the exit port 28, and is preferably connected to the exit port by a fitting 50 utilizing an interference fit to allow for quick coupling and uncoupling of the spigot 48 to the exit port 28. The fitting 50 is preferably made primarily of a thermally conductive material, such as brass. In this manner, the fitting 50 conducts heat to the base of the spigot 48. The fitting 50 extends so that it is flush with the exit port 28, or it may extend below the exit port 28. Thus, the exit port 28 is thermally coupled to the ambient atmosphere to allow heat to flow to the port 28. The thermally conductive nature of the fitting 50 serves to melt any ice which may otherwise form around the exit port 28 to ensure a clear path for the liquid through the exit port. Nearly any arrangment of coupling the exit port 28 or surrounding areas to a heat source may be used, so long as the liquid around the exit port remains unfrozen.

Figure 2:
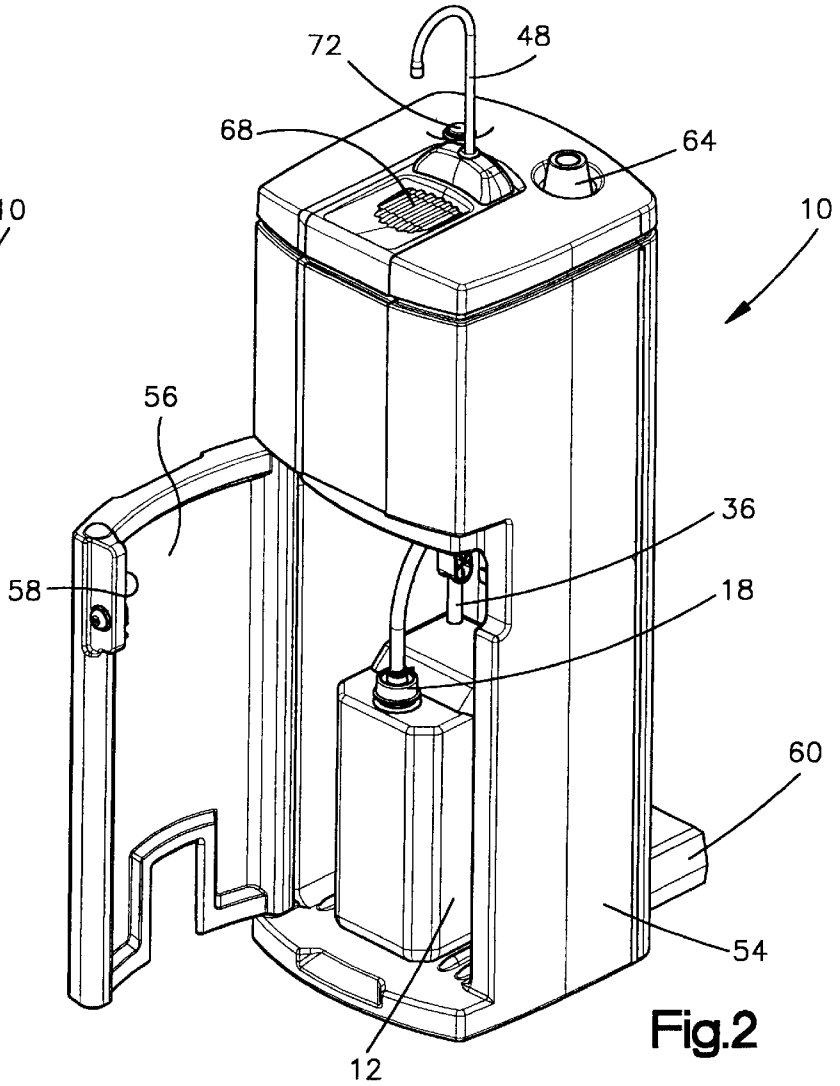
FIG. 2 is a perspective view of the water cooler and dispenser of FIG. 1, with the door shown in the open position.
Figure 1:
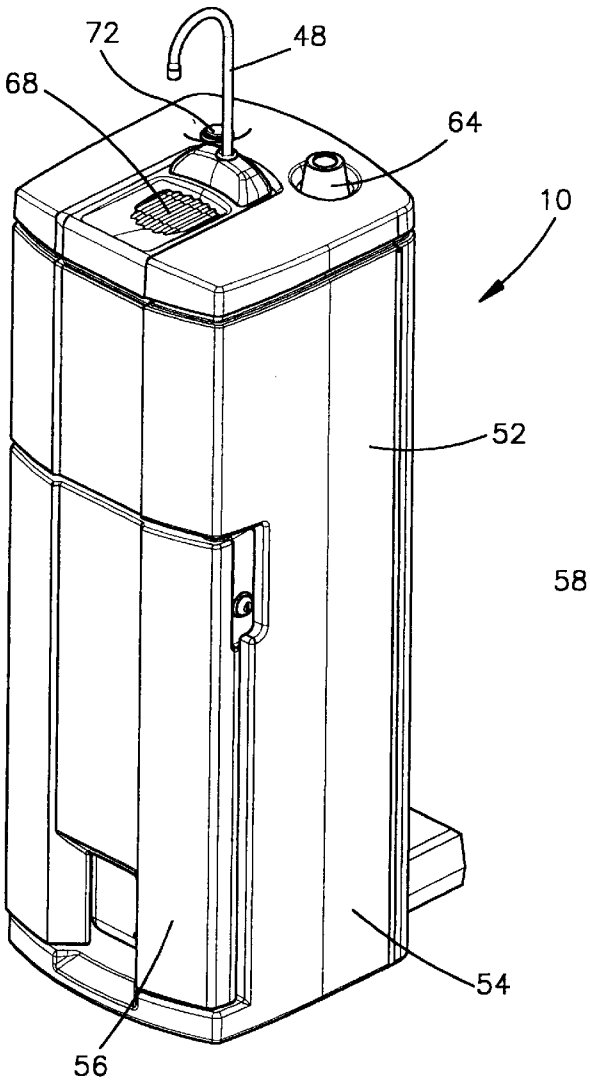
FIG. 1 is a perspective view of a preferred embodiment of the water cooler and dispenser of the present invention.
Figure 5:
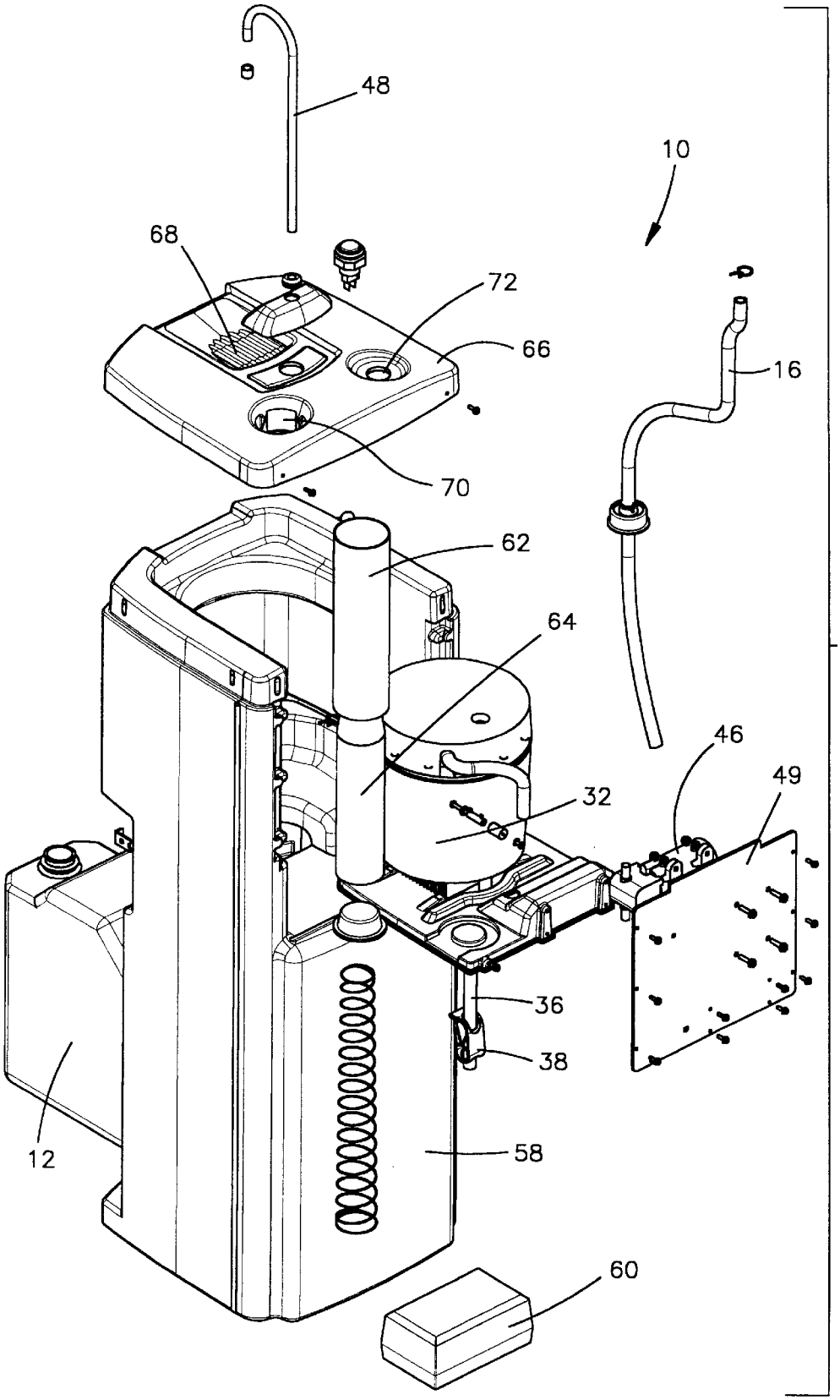
FIG. 5 is a perspective, exploded view of the water cooler and dispenser and FIG. 1.

Housing 52 houses the liquid supply 12, cooling reservoir 14, and conduit 16. The housing 12 includes a one piece cabinet 54 which has a door 56 reciprocal from an open position (FIG. 2) to a closed position (FIG. 1) to allow access inside the cabinet 54. In this manner, the liquid supply 12 may be accessed and replaced when it is empty. The door 56 preferably includes a lock 58 to allow selective access to the cabinet 54. As best shown in FIG. 5, the housing 52 also includes an integral, spring loaded cup dispenser 62 for supplying cups 64 to be used with the dispensed liquid. The top cap portion 66 of the housing includes the spigot fitting 50, a drain 68, a portal 70 for the dispensed cups 64, and a button 72 for triggering the dispenser to dispense liquid. The housing 52 has a rear wall 58, and external power supply 60 may be located against the rear wall 58. In the illustrated embodiment, the power supply 60 is external to the housing. However, the power supply 60 may also be located inside the housing if so desired.

When it is desired to receive cooled water from the cooling reservoir 14, the button 72 on the top cap 66 is pushed which activates the pump 46. The pump 46 then delivers water from the liquid supply 12 to the cooling reservoir 14. As it enters the cooling reservoir 14, the water may pass through the baffles 30 which diverts the water to ensure proper mixing and cooling. However, it is to be understood that the cover 20 may not have any baffles 30, and may be generally smooth. As incoming water enters the cooling reservoir 14, the volume of the cooling reservoir 14 is generally filled with liquid 53, as shown in FIG. 3A. As further illustrated in FIG. 3A, part of the liquid 53 may be frozen around the probe 42, forming an iceball 43. The top surface of the liquid is shown as surface 57. Because the exit port 28 is lower than the entry port 26, as water enters the reservoir 14 through the entry port 26, water is forced out of the exit port 28 due to the fact that the cooling reservoir/pump is a closed system. Water is then forced out of cooling reservoir 14 through the exit port 28 and out of the spigot 48.

Figure 3B:
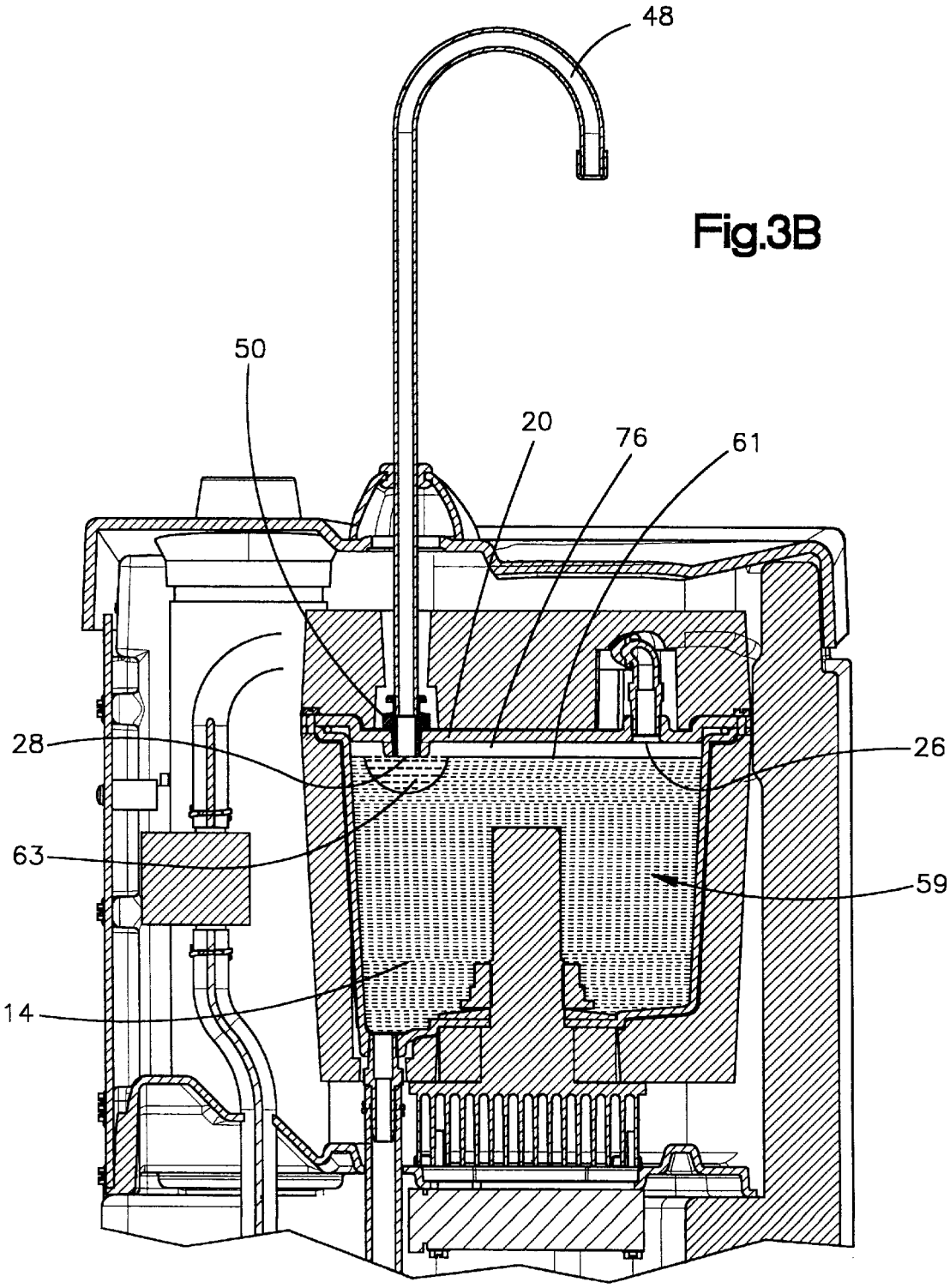
FIG. 3B is a detail view of the cooling chamber of FIG. 3, shown in a freeze-up condition.

FIG. 3B illustrates the cooling reservoir of FIG. 3A when the liquid 53 has cooled sufficiently such all the liquid has changed to a solid, thereby forming ice block 59 having a top surface 61. This is the freeze up condition. Due to the configuration of the ports 26, 28, a pocket of air 76 remains trapped at the top of the cooling reservoir 14 between the ice surface 61 and the cover 20.

The position of the air bubble 76, in conjunction with the thermally conductive fitting 50, serve to prevent the formation of ice around the exit and entry ports, and also ensures that there is an open path to allow the flow of water from the entry port to the exit port. Under freeze-up conditions liquid may still enter through the entry port 26 because the entry port 26 opens to the air bubble 76. Water may then travel along the top surface 61 (a solid surface), and exit through the exit port 28. The area immediately surrounding the exit port 28 is kept an elevated temperature by the thermally conductive fitting 50 such that liquid around the exit port 63 remains unfrozen. Thus, even during freeze up incoming water can enter through the entry port, travel across the surface 61, and exit through the exit port 28. Furthermore, when the incoming water travels across the surface 61, the surface 61 cools the incoming water. If baffles are utilized, the water may be further cooled as it travels through the chamber 14.

Many of the prior art dispensers utilize an entry port located near the top of the reservoir and an exit port at the bottom of the reservoir to take advantage of the fact that cooler water sinks. However, such devices are more prone to freeze-up, as it is difficult to maintain an open path between the entry and exit port. In contrast, the present invention utilizes entry and exit ports located near the top of the cooling reservoir to thereby minimize the chance of freeze-up interfering with the free flow of water.

Figure 8:
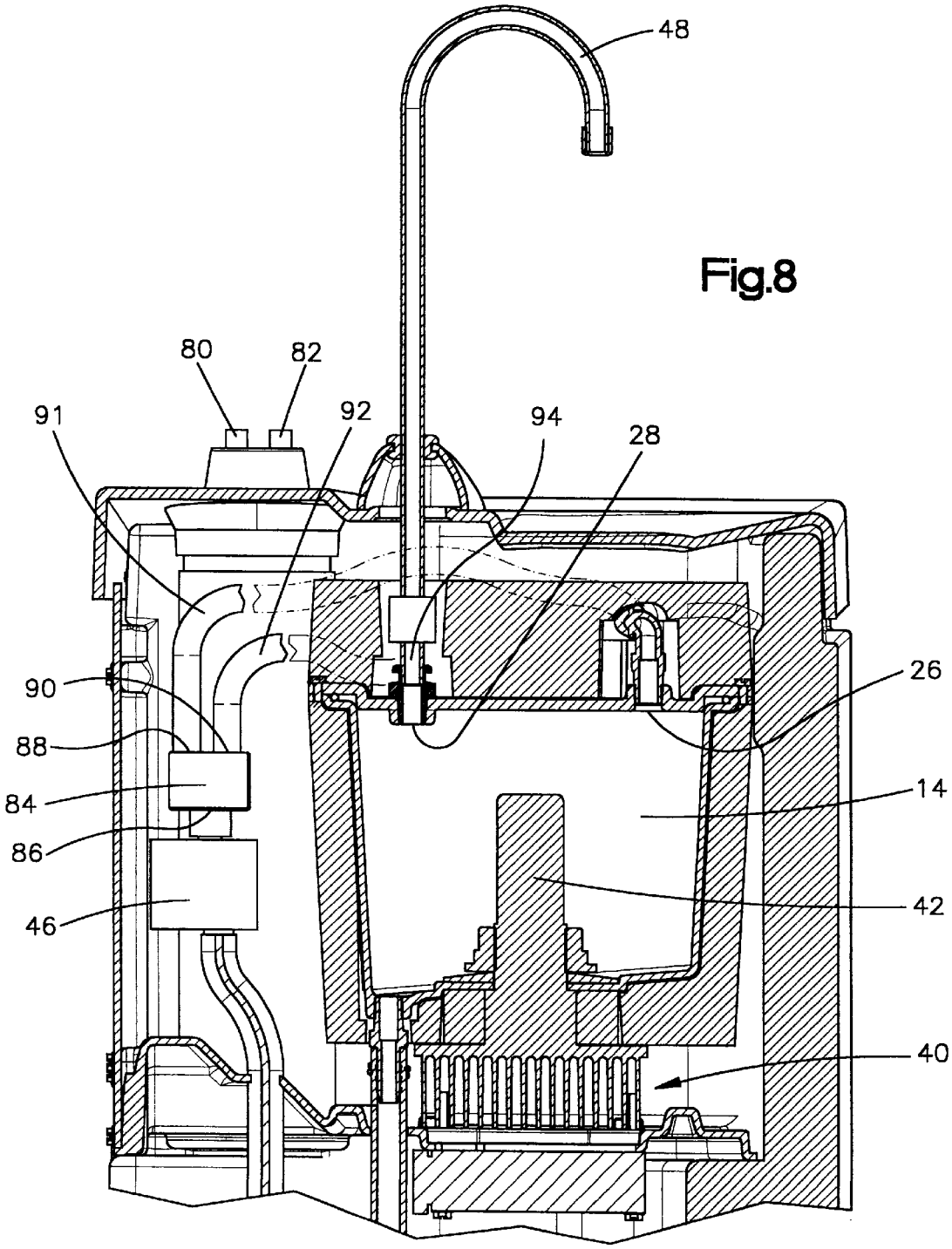
FIG. 8 is a schematic view illustrating an alternate embodiment of the couplings to and from the cooling reservoir.

In an alternate embodiment, the dispenser may be used to dispense both cooled water and ambient temperature water. As shown schematically in FIG. 8, the dispenser has a cold button 80 and an ambient button 82. The cold button 80 is activated when it is desired to receive cooled water dispensed from the cooling reservoir, and the ambient button 82 is activated when it is desired to received room temperature water dispensed directly from the liquid supply. When the cold button is pushed, the pump delivers water from the liquid supply 12 to the cooling reservoir 14. Water enters a 3-way solenoid 84 at the supply port 86, and exits the solenoid 84 at the cold port 88. Water then passes through the cold conduit 91 and enters the cooling reservoir through the entry port 26.

When it is desired to dispense water directly from the liquid supply 12, the ambient button 82 is pushed. This activates the pump 46 to deliver water to the 3-way solenoid 84. Water enters the solenoid 84 at the supply port 86, and exits the solenoid at the ambient port 90. Water then passes through the ambient source line 92 into the T fitting 94. Finally, the water travels upwards through the spigot 48 and is dispensed.

In a preferred embodiment, the thermoelectric device 40 and the pump 46 share power from the power source 60. The power source delivers power to the thermoelectric cooling device 40 as its default position. Upon demand, such as when one of the buttons is pushed, the power source 60 diverts power to the pump 46 so that water is thereby dispensed. Once the user releases the button the power is switched back to the cooling device. This arrangement requires the use of only a single power source to operate both the pump and the cooling device, and thus allows the size and cost of the power source 60 to be minimized.

In an alternate embodiment, a first pump is used for delivering liquid from the supply to the cooling reservoir, or liquid from the supply directly to the spigot, and a second pump is used for delivering liquid from the cooling reservoir to the spigot. In this embodiment, the system may not be a closed, forced-fed system, and thus the pumps may not be sealed pumps.

The preferred form of the dispenser has been described above. However, with the present disclosure in mind it is believed that obvious alterations to the preferred embodiments, to achieve comparable features and advantages in other assemblies, will be come apparent to those of ordinary skill in the art.

We claim:

1. A dispenser for cooling and dispensing liquids comprising:

a liquid supply;

a cooling reservoir, said cooling reservoir having an entry port and an exit port and being shaped so as to position a pocket of air at the top of said reservoir when said reservoir contains liquid whereby said entry port communicates with said air pocket; said cooling reservoir including a drain;

a conduit connected on one end to said liquid supply and on the other end to said entry port of said cooling reservoir;

a cooling element disposed inside said cooling reservoir; and a first pump for moving said liquid from said liquid supply to said cooling reservoir through said conduit.

2. The dispenser of claim 1 wherein said exit port is lower than said entry port.

3. The dispenser of claim 1 wherein exit port is adjacent said air bubble.

4. The dispenser of claim 1 wherein said exit port is thermally coupled a heat source to maintain the liquid surrounding said exit port is a liquid state.

5. The dispenser of claim 4 wherein said heat source is the ambient atmosphere.

6. The dispenser of claim 1 wherein said cooling element is located below said entry port and said exit port.

7. The dispenser of claim 1 wherein said cooling reservoir includes a series of baffles therein to divert the path of liquid entering said cooling reservoir through said entry port.

8. The dispenser of claim 1 wherein said pump is a sealed pump.

9. The dispenser of claim 1 wherein said cooling element is a thermoelectric cooling device.

10. The dispenser of claim 1 further comprising a spigot coupled to said exit port of said cooling reservoir to guide liquid passing through said exit port in a controlled manner.

11. The dispenser of claim 10 wherein said spigot is coupled to said exit port by a thermally conductive material.

12. The dispenser of claim 11 wherein said thermally conductive material is brass.

13. The dispenser of claim 11 wherein said spigot is connected to said exit port by an interference fit to thereby allow quick coupling and uncoupling of said spigot to said exit port.

14. The dispenser of claim 7 wherein said cooling reservoir includes a cover, a bottom and at least one side wall, and wherein said cooling element is passed through said bottom.

15. The dispenser of claim 14 wherein said entry port, said exit port and said baffles are located in said cover.

16. The dispenser of claim 1 further comprising a housing for receiving said liquid supply, said cooling reservoir, said cooling element and said conduit.

17. The dispenser of claim 16 wherein said housing includes a one-piece cabinet shaped to receive said liquid supply, said cabinet having a door reciprocable from a closed position to an open position to allow access to said cabinet, said housing further including a lock to secure said door in said closed position.

18. The dispenser of claim 17 wherein said housing includes an integral cup dispenser for supplying cups to be used with said dispensed liquid.

19. The dispenser of claim 1 further comprising an insulating sleeve shaped to receive said cooling reservoir.

20. The dispenser of claim 1 wherein said cooling reservoir is sealed such that when liquid is delivered from said liquid supply to said entry port by said first pump, liquid is thereby dispensed out of said exit port.

21. The dispenser of claim 1 wherein said cooling probe and said first pump share a power source, said power source being switchable so as to deliver power to said first pump or said cooling probe upon demand.

22. The dispenser of claim 1 further comprising a second pump for dispensing liquid from said cooling reservoir out of said exit port.

23. A dispenser for cooling and dispensing liquids comprising:

a liquid supply;

an opening through which said liquid exits said dispenser;

a cooling reservoir, said cooling reservoir having an entry port and an exit port and being shaped so as to position a pocket of air at the top of said reservoir when said reservoir contains liquid such that said entry port communicates through said air pocket; said exit port being thermally coupled a heat source to maintain the liquid surrounding said exit port in a liquid state;

a cool conduit for supplying liquid from said liquid supply to said cooling reservoir;

an ambient conduit for supplying liquid from said liquid supply to said opening;

a cooling element disposed inside said cooling reservoir; and a first pump for moving said liquid through said cool conduit and through said ambient conduit.

24. The dispenser of claim 23 wherein said exit port is lower than said entry port.

25. The dispenser of claim 23 wherein exit port is adjacent said air bubble.

26. The dispenser of claim 23 further comprising a supply tube coupled to said liquid supply, said dispenser further comprising a three-way valve coupled to said supply tube, said cool conduit, and said ambient conduit, whereby said three-way valve directs liquid from said supply tube to said cool conduit or to said ambient conduit.

27. The dispenser of claim 26 further comprising a T-valve coupled to said ambient conduit, said exit port, and said opening for directing liquid from said ambient conduit and said exit port to said opening.

28. A dispenser for cooling and dispensing liquids comprising:

a liquid supply;

a cooling reservoir, said cooling reservoir having an entry port and an exit port and being shaped so as to position a pocket of air at the top of said reservoir when said reservoir contains liquid; said entry and exit ports being thermally coupled to a heat source;

a conduit connected on one end to said liquid supply and on the other end to said entry port of said cooling reservoir;

a cooling element disposed inside said cooling reservoir; and a first pump for moving said liquid from said liquid supply to said cooling reservoir through said conduit.

29. The dispenser of claim 28 wherein said entry and said exit ports are located adjacent said air pockets.

30. A cooling reservoir for storing liquid to be dispensed, the reservoir comprising:

a body;

an entry port in said body; and an exit port in said body adjacent said entry port, said body being shaped so as to trap a pocket of air between said entry port and said exit port when said body is filled with liquid.

31. The cooling reservoir of claim 30 wherein said entry port communicates with said air bubble.

32. The cooling reservoir of claim 30 wherein said entry port is adjacent said air bubble.

* * * * *